US005167731A

United States Patent [19]

Minami et al.

[11] Patent Number: 5,167,731

[45] Date of Patent: Dec. 1, 1992

[54] MARTENSITIC STAINLESS STEEL FOR AN OIL WELL

[75] Inventors: Yusuke Minami; Shuji Hashizume; Tatsuo Takaoka; Takemi Yamada, all of Kawasaki, Japan

[73] Assignee: NKK Corporation, Tokyo, Japan

[21] Appl. No.: 734,216

[22] Filed: Jul. 22, 1991

[30] Foreign Application Priority Data

Jul. 30, 1990 [JP] Japan ..... 2-202076

[51] Int. Cl.[5] ..... C22C 38/22

[52] U.S. Cl. ..... 148/325; 420/67

[58] Field of Search ..... 148/325; 420/67, 69, 420/61

[56] References Cited

U.S. PATENT DOCUMENTS

| | | | |
|---|---|---|---|
| 2,693,413 | 11/1954 | Kirkby et al. | 420/69 |
| 3,389,991 | 6/1968 | Tanczyn | 420/70 |
| 4,838,960 | 6/1989 | Yoshino | 148/325 |
| 4,938,808 | 7/1990 | Miura et al. | 148/325 |

FOREIGN PATENT DOCUMENTS

| | | | |
|---|---|---|---|
| 0293165 | 11/1988 | European Pat. Off. . | |
| 2348275 | 11/1977 | France . | |
| 58-199850 | 11/1983 | Japan . | |
| 60-174859 | 9/1985 | Japan . | |
| 61-3391 | 1/1986 | Japan . | |
| 61-207550 | 9/1986 | Japan . | |
| 225398 | 5/1943 | Switzerland . | |
| 648354 | 3/1985 | Switzerland | 148/325 |

*Primary Examiner*—Deborah Yee

*Attorney, Agent, or Firm*—Frishauf, Holtz, Goodman & Woodward

[57] ABSTRACT

A martensitic stainless steel having good corrosion resistance suitable for use in an oil well having 0.08 to 0.25 wt. % C, 14 to 16 wt. % Cr, 1.0 wt. % or less Si, 2.0 wt. % or less Mn, 0.5 to 3.0 wt. % Ni, 0.03 to 0.10 wt. % N, 0.04 wt. % or less P, 0.01 wt. % or less S, 0.1 to 1.0 wt. % Mo, the balance being Fe and inevitable impurities. The Cr, C, Ni and N being in amounts such that 20 wt. % $\geqq Cr-12C+0.75\ Ni+10N \geqq 13$ wt. %. The martensitic stainless steel having a content of δ-ferrite of 10% or less. The martensitic stainless steel can contain at least one of 0.05 to 0.30 wt. % V and 0.01 to 0.1 wt. % Nb. Also the martensitic stainless steel can contain 0.5 to 3.0 wt. % Cu. Further the martensitic stainless steel can contain 0.5 to 3.0 wt. % Cu, and at least one of 0.05 to 3.0 wt. % V and 0.01 to 0.1 wt. % Nb.

26 Claims, 1 Drawing Sheet

MARTENSITIC STAINLESS STEEL FOR AN OIL WELL

BACKGROUND OF THE INVENTION

1. Field of the Invention

The present invention relates to martensitic stainless steel for a high depth oil well where there exists moist carbon dioxide gas, salinity, and hydrogen sulfide.

2. Description of the Related Arts

Conventionally, high strength carbon steel or low alloy steel has been widely used for oil well pipes. Recently, many attempts have been made to develop high depth oil wells in order to maintain oil resources. Since the high depth oil wells are located under an environment which there exists moist carbon dioxide gas, the conventional carbon steel or low alloy steel has been replaced by high alloy steel, such as 13% Cr martensite steel. The required properties of the high alloy steel are strength, corrosion resistance, and stress corrosion cracking resistance. The steel which satisfies these properties is disclosed in Japanese Examined Patent Publication No. 3391/1986, Patent Application Laid Open Nos. 199850/1983 and 207550/1986. However, as the depth of oil wells is further increased, carbon dioxide, hydrogen sulfide and chloride ion will be present and some oil wells may be exposed to an environment whose temperature exceeds 150° C. The aforesaid steel fails to provide satisfactory corrosion resistance under the environment described above. To comply with this, duplex stainless steel has been used to satisfy the required corrosion resistance.

Since the duplex stainless steel is more expensive compared with 13% Cr steel, therefore, the steel disclosed in Japanese Patent Application Laid Open No. 174859/1986 has been developed to provide more excellent corrosion resistance and economic efficiency compared with the conventional 13% Cr steel.

However, the steel disclosed in Japanese Patent Application Laid Open No. 174859/1985 is high Ni-contained steel and suffers from sulfide stress corrosion cracking resistance. The sulfide stress corrosion cracking resistance is abridged and called SSC hereafter. Since Ni is expensive, there is no marked difference between high Ni-contained steel and the duplex stainless steel in terms of economic efficiency as well. Therefore, it is urgently called for to develop steel whose corrosion resistance is more excellent than 13% Cr steel, and more economically efficient than the duplex stainless steel.

SUMMARY OF THE INVENTION

It is an object of the present invention to provide steel which is excellent in terms of corrosion resistance, strength, and economical efficiency even under an environment in a high temperature region.

To attain the object, in accordance with the present invention, martensitic stainless steel for oil well is provided which consists essentially of:

0.08 to 0.25 wt. % C,
14 to 16 wt. % Cr,
1.0 wt. % or less Si,
2.0 wt. % or less Mn,
0.5 to 3.0 wt. % Ni,
0.03 to 0.10 wt. % N,
0.04 wt. % or less P,
0.01 wt. % or less S,
0.1 to 1.0 wt. % Mo,
the balance being Fe and inevitable impurities,
said Cr, C, Ni and N being in amount such that $Cr-12C+0.75Ni+10N \geqq 13$ wt. %, and
said martensitic stainless steel having δ-ferrite of 10% or less.

The martensitic stainless steel can further contain at least one of 0.05 to 0.30 wt. % V and 0.01 to 0.1 wt. % Nb. That is, the steel can further contain 0.05 to 0.30 wt. % V. The steel can further contain 0.01 to 0.1 wt. % Nb. The steel can further contain 0.05 to 0.30 wt. % V and 0.01 to 0.1 wt. % Nb.

In addition, the martensitic stainless steel can further contain 0.5 to 3.0 wt. % Cu.

It is also acceptable that the martensitic stainless steel further contains 0.5 to 3.0 wt. % Cu and at least one of 0.05 to 0.30 wt. % V and 0.01 to 0.1 wt. % Nb. That is, the steel can contain 0.5 to 3.0 wt. % Cu and 0.05 to 0.30 wt. % V. The steel can contain 0.5 to 3.0 wt. % Cu and 0.01 to 0.1 wt. % Nb. The steel can contain 0.5 to 3.0 wt. % Cu, 0.05 to 0.30 wt. % V and 0.01 to 0.1 wt. % Nb.

DESCRIPTION OF THE PREFERRED EMBODIMENT

Figure 1:
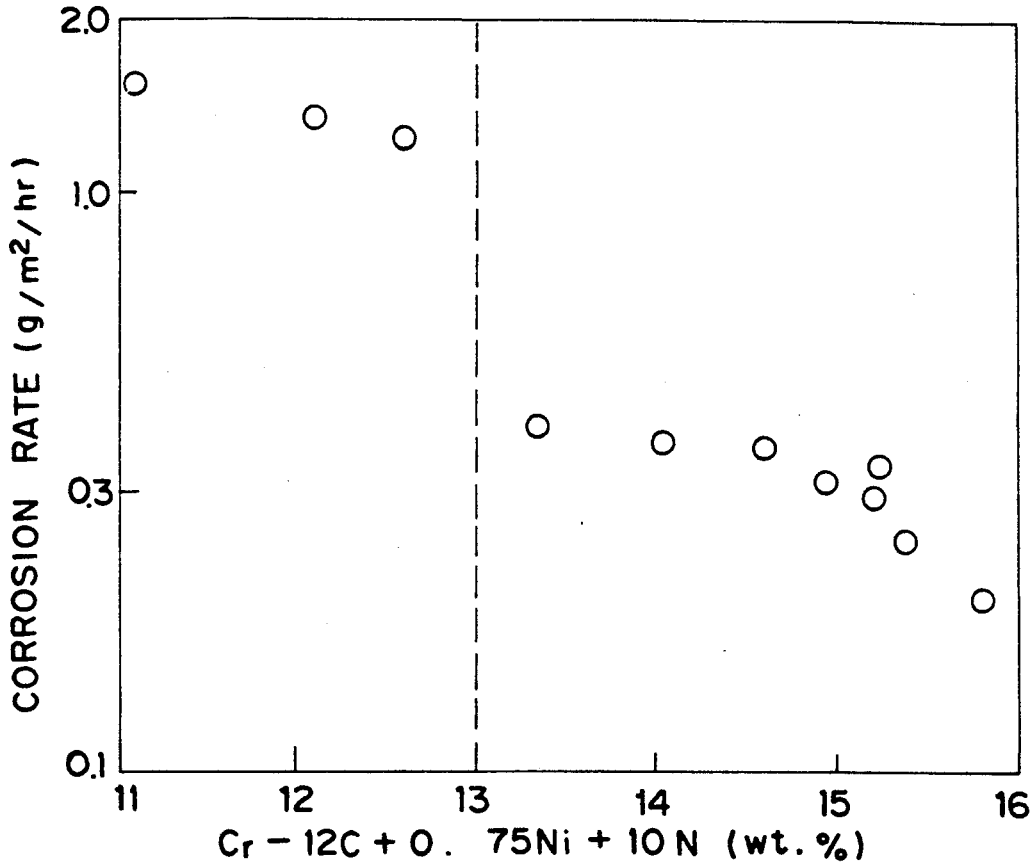
FIG. 1 is a graph which depicts the relation between corrosion rate and $Cr-12C+0.75Ni+10N$ wt. %.

It is effective to increase the amount of Cr in order to improve the corrosion resistance of Cr steel. On the other hand, if an attempt is made to increase the amount of Cr, the formation of δ-ferrite phase will be promoted so that the strength and toughness of steel may be reduced. To prevent a drop in the strength and toughness of steel, it will be necessary to preclude the formation of δ-ferrite phase. If the amount of Ni is increased, there will be restrictions imposed on the SSC resistance and cost. It is true that the increase in the amount of C is effective to preclude the formation of the δ-ferrite phase, but carbide is formed during tempering, which deteriorates the corrosion resistance so that the content of C may be restricted.

Considering the restrictions imposed on the content of Cr, the inventors carried out various kinds of experiments and research. The results of the corrosion tests, which will be described later, discovered a marked reduction in corrosion rate if the value given by a relational expression of $Cr-12C+0.75Ni+10N$ exceeds 13 wt. %. The results of the impact test and tensile test, which will be also described later, reveal that the toughness and tensile strength will be lowered if the δ-ferrite phase exceeds 10%.

The reason why the chemical composition of stainless steel as defined by the present invention must be limited will be explained herein:

C is an austenite former and an effective element to obtain a martensite phase. C is desired to range from 0.08 to 0.25 wt. %. If it is less than 0.08 wt. %, the δ-ferrite phase will be increased so that it is necessary to increase high cost Ni to preclude the formation of δ-ferrite phase. If C exceeds 0.25 wt. %, the amount of precipitation of Cr carbide will be increased, thereby reducing corrosion resistance.

Cr is an element effective to improve corrosion resistance. If the content is small, corrosion resistance is equivalent to that of 13% Cr steel, while the amount of δ-ferrite phase will be increased if the content is increased. Therefore, it will be preferable if the content of Cr ranges from 14 to 16 wt. %.

Si is necessary as a deoxidizing agent, but it is a powerful ferrite former. Therefore, it will be preferable if the content is 1.0 wt. % or less.

Mn is an effective element as a deoxidizing agent and a desulfurizing agent and an element to form an austenite phase. Excess addition may saturate the effect. Therefore, it is desirable that the content shall be 2.0 wt. % or less.

Ni is an austenite former and it is effective to preclude the formation of the δ-ferrite phase. An increase in the content of Ni lowers the SSC resistance and calls for high cost. Therefore, it is desirable that the content should range from 0.5 to 3.0 wt. %.

N stands for an austenite former. If the content is insufficient, it will be impossible to expect much effect while workability will be damaged if the content is excess. Therefore, the content is specified to range from 0.03 to 0.10 wt. %.

Both P and S are elements which degrade the hot workability and stress corrosion cracking resistance of steel. P is specified to be 0.04 wt. % or less while S is specified to be 0.01 wt. % or less.

Mo is an effective element on pitting corrosion resistance, but Mo is expensive. Furthermore, an excess content of Mo may increase the δ-ferrite phase. Therefore, it is desirable that the content shall range from 0.1 to 1.0 wt. %.

V and Nb are a powerful carbide forming elements and they are very effective to produce more fine grain structures. However, since they are ferrite formers, their contents must be limited. More preferably, V should range from 0.05 to 0.30 wt. % while Nb should range from 0.01 to 0.1 wt. %.

Cu is an element which is effective to improve corrosion resistance similar to Mo. Cu is an expensive element and if excessively added, say, over 3.0 wt. %, the effect will be saturated. Therefore, it is desirable that the content shall range from 0.5 to 3.0 wt. %.

The preferred embodiments of the present invention will be described:

Table 1 shows chemical compositions of invented steel A to F and comparative steel 1 to 6. The test steels are ingot steels and rolled to a thickness of 12 mm and austenized and tempered so that various kinds of test pieces are sampled. Table 2 shows the test results.

With regards to corrosion tests, the test pieces are immersed in a 10% NaCl solution with carbon dioxide of 29.95 atm.-hydrogen sulfide of 0.05 atm. for 366 hours to measure mass loss. The test temperature is 200° C. The corrosion rate is represented by the corrosion loss of a 1 $m^2$ test piece per hour.

The tensile test was carried out at an ambient temperature, using a test piece of 6 mm dia and 30 mm gauge length. Y.S. given in Table 1 indicates the yield strength of the test piece.

When carrying out an impact test, a full-sized test piece having a 2 mm V notch was used and tested at a temperature of −40° C. The absorbed energy denoted by kgf·m was obtained.

To measure the amount of δ-ferrite, a test piece which was subject to heat treatment was tested based on an image processing method, using an optical microscope.

The corrosion rate of conventional 13% Cr steel (comparison steels of 1, 2, and 4) exceeds 1 $g/m^2/hr$ and suffers from inferior corrosion resistance. The value of a relational expression of Cr−12 C+0.75 Ni+10N is adopted as an axis of abcissa while the corrosion rate is represented by an axis of ordinate. Under this assumption FIG. 1 shows the relation between the value of the aforesaid relational expression and the corrosion rate. If the value of Cr−12 C+0.75 Ni+10N exceeds 13 wt. %, the corrosion rate will be reduced to 0.48 $g/m^2/hr$ or less. Therefor it will be said that if the value of Cr−12 C+0.75 Ni+10N exceeds 13 wt. %, the corrosion resistance will be dramatically improved.

If the value of Cr−12 C+0.75+10N stated above ranges from 13 to 20 wt. %, it will be acceptable. More preferably, the value shall range from 14.5 to 20 wt. % from the view point of corrosion rate. It will be much more preferable if it ranges from 14.5 to 16 wt. %.

The δ-ferrite phase does not affect the corrosion rate, but deteriorates the toughness. The comparison steel 3, 5, and 6 whose δ-ferrite phase exceeds 10% lowers their absorbed energy below 1 kgf·m and suffers from insufficient toughness. The δ-ferrite phase also lowers the strength at an ambient temperature.

When the δ-ferrite phase exceeds 10%, the yielding point strength will drop to 55 $kgf/mm^2$ or less. Preferably, the δ-ferrite phase should be 10% or less. 5% or less is more preferable.

Compared with 13% Cr steel, the steel according to the present invention provides one third of corrosion rate and indicates satisfactory properties in terms of strength and toughness.

TABLE 1

| Steel | weight % | | | | | | | | | |
|---|---|---|---|---|---|---|---|---|---|---|
| | C | Si | Mn | P | S | Cr | Ni | Mo | N | Others |
| Steel according to the present invention | | | | | | | | | | |
| A | 0.10 | 0.3 | 0.7 | 0.01 | 0.003 | 15.2 | 1.0 | 0.5 | 0.06 | |
| B | 0.20 | 0.6 | 0.6 | 0.02 | 0.006 | 15.7 | 2.7 | 0.7 | 0.05 | |
| C | 0.15 | 0.5 | 0.4 | 0.01 | 0.004 | 14.6 | 1.8 | 0.8 | 0.08 | V:0.15 |
| D | 0.12 | 0.4 | 0.5 | 0.01 | 0.003 | 14.4 | 1.5 | 0.5 | 0.05 | Nb:0.06 |
| E | 0.21 | 0.6 | 0.8 | 0.02 | 0.005 | 14.8 | 0.6 | 0.6 | 0.06 | V:0.10, Nb:0.04 |
| F | 0.18 | 0.4 | 0.6 | 0.01 | 0.007 | 15.2 | 0.8 | 0.3 | 0.04 | V:0.08, Nb:0.05 Cu:2 |
| Comparison steel | | | | | | | | | | |
| 1 | 0.20 | 0.4 | 0.6 | 0.02 | 0.009 | 13.4 | — | — | 0.01 | |
| 2 | 0.10 | 0.5 | 0.4 | 0.01 | 0.008 | 13.2 | | | 0.01 | |
| 3 | 0.05 | 0.3 | 0.3 | 0.02 | 0.007 | 15.5 | 0.2 | 0.5 | 0.02 | |
| 4 | 0.30 | 0.5 | 0.6 | 0.02 | 0.006 | 14.8 | 1.2 | 0.3 | 0.05 | |
| 5 | 0.12 | 0.4 | 0.8 | 0.01 | 0.003 | 16.7 | 1.8 | 0.4 | 0.04 | |
| 6 | 0.10 | 0.5 | 0.6 | 0.01 | 0.004 | 15.6 | 0.8 | 0.3 | 0.02 | |

TABLE 2

| Steel | Cr−12C + 0.75 Ni + 10 N | Corrosion rate | Y. S | Absorbed energy | δ-ferrite phase |
|---|---|---|---|---|---|
| Steel according to the present invention | | | | | |
| A | 15.35 | 0.25 | 62 | 13.0 | 0 |
| B | 15.80 | 0.20 | 68 | 10.0 | 0 |
| C | 14.95 | 0.31 | 65 | 12.5 | 0 |
| D | 14.59 | 0.33 | 63 | 8.0 | 5 |
| E | 13.33 | 0.40 | 61 | 9.0 | 0 |
| F | 14.04 | 0.37 | 60 | 11.5 | 0 |
| Comparison steel | | | | | |
| 1 | 11.1 | 1.55 | 61 | 7.0 | 0 |
| 2 | 12.1 | 1.35 | 58 | 2.0 | 0 |
| 3 | 15.25 | 0.32 | 50 | 0.3 | 25 |
| 4 | 12.60 | 1.27 | 73 | 3.3 | 0 |
| 5 | 17.01 | 0.23 | 53 | 0.2 | 30 |
| 6 | 15.2 | 0.30 | 54 | 0.8 | 15 |

What is claimed is:

1. A martensitic stainless steel having corrosion resistance characteristics suitable for use in an oil well, the stainless steel consisting essentially of:

0.08 to 0.25 wt. % C,
14 to 16 wt. % Cr,
1.0 wt. % or less Si,
2.0 wt. % or less Mn,
0.5 to 3.0 wt. % Ni,
0.03 to 0.10 wt. % N,
0.04 wt. % or less P,
0.01 wt. % or less S,
0.1 to 1.0 wt. % Mo,
the balance being Fe and inevitable impurities,
said Cr, C, Ni and N being in amount such that 20 wt. $\% \geqq Cr-12C+0.75Ni+10N \geqq 13$ wt. %, and
said martensitic stainless steel having a content of δ-ferrite of 10% or less.

2. The martensite stainless steel of claim 1, wherein said Cr, C, Ni and N are in amount such that 20 wt. $\% \geqq Cr-12C+0.75Ni+10N \geqq 14.5$ wt. %.

3. The martensite stainless steel of claim 2, wherein said Cr, C, Ni and N are in amount such that 16 wt. $\% \geqq Cr-12C+0.75Ni+10N \geqq 14.5$ wt. %.

4. The martensitic stainless steel of claim 1, wherein said content of the δ-ferrite is 5% or less.

5. A martensitic stainless steel having corrosion resistance characteristics suitable for use in an oil well, the stainless steel consisting essentially of:

0.08 to 0.25 wt. % C,
14 to 16 wt. % Cr,
1.0 wt. % or less Si,
2.0 wt. % or less Mn,
0.5 to 3.0 wt. % Ni,
0.03 to 0.10 wt. % N,
0.04 wt. % or less P,
0.01 wt. % or less S,
0.1 to 1.0 wt. % Mo,
at least one of 0.05 to 0.30 wt. % V and 0.01 to 0.1 wt. % Nb,
the balance being Fe and inevitable impurities,
said Cr, C, Ni and N being in amount such that 20 wt. $\% \geqq Cr-12C+0.75Ni+10N \geqq 13$ wt. %, and
said martensitic stainless steel having a content of δ-ferrite of 10% or less.

6. The martensitic stainless steel of claim 5, wherein said steel has a composition of 0.08 to 0.25 wt. % C, 14 to 16 wt. % Cr, 1.0 wt. % or less Si, 2.0 wt. % or less Mn, 0.5 to 3.0 wt. % Ni, 0.03 to 0.10 wt. % N, 0.04 wt. % or less P, 0.01 wt. % or less S, 0.1 to 1.0 wt. % Mo, 0.05 to 0.30 wt. % V, the balance being Fe and inevitable impurities.

7. The martensitic stainless steel of claim 5, wherein said steel has a composition of 0.08 to 0.25 wt. % C, 14 to 16 wt. % Cr, 1.0 wt. % or less Si, 2.0 wt. % or less Mn, 0.5 to 3.0 wt. % Ni, 0.03 to 0.10 wt. % N, 0.04 wt. % or less P, 0.01 wt. % or less S, 0.1 to 1.0 wt. % Mo, 0.01 to 0.1 wt. % Nb, the balance being Fe and inevitable impurities.

8. The martensitic stainless steel of claim 5, wherein said steel has a composition of 0.08 to 0.25 wt. % C, 14 to 16 wt. % Cr, 1.0 wt. % or less Si, 2.0 wt. % or less Mn, 0.5 to 3.0 wt. % Ni, 0.03 to 0.10 wt. % N, 0.04 wt. % or less P, 0.01 wt. % or less S, 0.1 to 1.0 wt. % Mo, 0.05 to 0.30 wt. % V, 0.01 to 0.1 wt. % Nb, the balance being Fe and inevitable impurities.

9. The martensitic stainless steel of claim 5, wherein said Cr, C, Ni and N are in amount such that 20 wt. $\% \geqq Cr-12C+0.75Ni+10N \geqq 14.5$ wt. %.

10. The martensitic stainless steel of claim 9, wherein said Cr, C, Ni and N are in amount such that 16 wt. $\% \geqq Cr-12C+0.75Ni+10N \geqq 14.5$ wt. %.

11. The martensitic stainless steel of claim 5, wherein said content of the δ-ferrite is 5% or less.

12. A martensitic stainless steel having corrosion resistance characteristics suitable for use in an oil well, the stainless steel consisting essentially of:

0.08 to 0.25 wt. % C,
14 to 16 wt. % Cr,
1.0 wt. % or less Si,
2.0 wt. % or less Mn,
0.5 to 3.0 wt. % Ni,
0.03 to 0.10 wt. % N,
0.04 wt. % or less P,
0.01 wt. % or less S,
0.1 to 1.0 wt. % Mo,
0.5 to 3.0 wt. % Cu,
the balance being Fe and inevitable impurities,
said Cr, C, Ni and N being in amount such that 20 wt. $\% \geqq Cr-12C+0.75Ni+10N \geqq 13$ wt. %, and
said martensitic stainless steel having a content of δ-ferrite of 10% or less.

13. The martensitic stainless steel of claim 12, wherein said Cr, C, Ni and N are in amount such that 20 wt. $\% \geqq Cr-12C+0.75Ni+10N \geqq 14.5$ wt. %.

14. The martensitic stainless steel of claim 13, wherein said Cr, C, Ni and N are in amount such that 16 wt. $\% \geqq Cr-12C+0.75Ni+10N \geqq 14.5$ wt. %.

15. The martensitic stainless steel of claim 12, wherein said content of the δ-ferrite is 5% or less.

16. A martensitic stainless steel having corrosion resistance characteristics suitable for use in an oil well, the stainless steel consisting essentially of 0.08 to 0.25 wt. % C,
14 to 16 wt. % Cr,
1.0 wt. % or less Si,
2.0 wt. % or less Mn,
0.5 to 3.0 wt. % Ni,
0.03 to 0.10 wt. % N,
0.04 wt. % or less P,
0.01 wt. % or less S,
0.1 to 1.0 wt. % Mo,
0.5 to 3.0 wt. % Cu,
at least one of 0.05 to 0.30 wt. % V and 0.01 to 0.1 wt. % Nb,
the balance being Fe and inevitable impurities, said Cr, C, Ni and N being in an amount such that 20 wt. % $\geqq$ Cr − 12C + 0.75Ni + 10N $\geqq$ 13 wt. %, and said martensitic stainless steel having a content of δ-ferrite of 10% or less.

17. The martensitic stainless steel of claim 16, wherein said steel has a composition of 0.08 to 0.25 wt. % C, 14 to 16 wt. % Cr, 1.0 wt. % or less Si, 2.0 wt. % or less Mn, 0.5 to 3.0 wt. % Ni, 0.03 to 0.10 wt. % N, 0.04 wt. % or less P, 0.01 wt. % or less S, 0.1 to 1.0 wt. % Mo, 0.5 to 3.0 wt. % Cu, 0.05 to 0.30 wt. % V, 0.01 to 0.1 wt. % Nb, the balance being Fe and inevitable impurities.

18. The martensitic stainless steel of claim 17, wherein said Cr, C, Ni and N are in amount such that 20 wt. % $\geqq$ Cr − 12C + 0.75Ni + 10N $\geqq$ 14.5 wt. %.

19. The martensitic stainless steel of claim 18, wherein said Cr, C, Ni and N are in amount such that 16 wt. % $\geqq$ Cr − 12C + 0.75Ni + 10N $\geqq$ 14.5 wt. %.

20. The martensitic stainless steel of claim 16, wherein said content of the δ-ferrite is 5% or less.

21. The martensitic stainless steel of claim 1, wherein said steel has a composition of 0.1 wt. % C, 0.3 wt. % Si, 0.7 wt. % Mn, 0.01 wt. % P, 0.003 wt. % S, 15.2 wt. % Cr, 1.0 wt. % Ni, 0.5 wt. % Mo and 0.06 wt. % N.

22. The martensitic stainless steel of claim 1, wherein said steel has a composition of 0.2 wt. % C, 0.6 wt. % Si, 0.6 wt. % Mn, 0.02 wt. % P, 0.006 wt. % S, 15.7 wt. % Cr, 2.7 wt. % Ni, 0.7 wt. % Mo and 0.05 wt. % N.

23. The martensitic stainless steel of claim 5, wherein said steel has a composition of 0.15 wt. % C, 0.5 wt. % Si, 0.4 wt. % Mn, 0.01 wt. % P, 0.004 wt. % S, 14.6 wt. % Cr, 1.8 wt. % Ni, 0.8 wt. % Ni, 0.8 wt. % Mo, 0.08 wt. % N and 0.15 wt. % V.

24. The martensitic stainless steel of claim 5, wherein said steel has a composition of 0.12 wt. % C, 0.4 wt. % Si, 0.5 wt. % Mn, 0.1 wt. % P, 0.003 wt. % S, 14.4 wt. % Cr, 1.5 wt. % Ni, 0.5 wt. % Mo, 0.05 wt. % N and 0.06 wt. % Nb.

25. The martensitic stainless steel of claim 5, wherein said steel has a composition of 0.21 wt. % C, 0.6 wt. % Si, 0.8 wt. % Mn, 0.02 wt. % P, 0.005 wt. % S, 14.8 wt. % Cr, 0.6 wt. % Ni, 0.6 wt. % Mo, 0.06 wt. % N, 0.10 wt. % V and 0.04 wt. % Nb.

26. The martensitic stainless steel of claim 16, wherein said steel has a composition of 0.18 wt. % C, 0.4 wt. % Si, 0.6 wt. % Mn, 0.1 wt. % P, 0.007 wt. % S, 15.2 wt. % Cr, 0.8 wt. % Ni, 0.3 wt. % Mo, 0.04 wt. % N, 0.08 wt. % V, 0.05 wt. % Nb and 2 wt. % Cu.

* * * * *